US009877891B2

(12) United States Patent
James

(10) Patent No.: US 9,877,891 B2
(45) Date of Patent: Jan. 30, 2018

(54) MASSAGE SHOE

(71) Applicant: Andrew Lee James, Orlando, FL (US)

(72) Inventor: Andrew Lee James, Orlando, FL (US)

( * ) Notice: Subject to any disclaimer, the term of this patent is extended or adjusted under 35 U.S.C. 154(b) by 22 days.

(21) Appl. No.: 14/811,574

(22) Filed: Sep. 11, 2015

(65) Prior Publication Data

US 2017/0071283 A1 Mar. 16, 2017

(51) Int. Cl.

| | |
|---|---|
| ***A61H 23/02*** | (2006.01) |
| ***A43B 3/00*** | (2006.01) |
| ***A43B 7/14*** | (2006.01) |

(52) U.S. Cl.

CPC ..... *A61H 23/02* (2013.01); *A43B 3/0005* (2013.01); *A43B 7/146* (2013.01); *A61H 2201/164* (2013.01); *A61H 2201/165* (2013.01); *A61H 2201/5033* (2013.01); *A61H 2205/12* (2013.01); *A61H 2205/125* (2013.01); *A61H 2209/00* (2013.01)

(58) Field of Classification Search

CPC .... A43B 7/00; A43B 7/146; A61H 2201/164; A61H 2201/165; A61H 2205/12; A61H 2205/125; A61H 2209/00; A61H 23/02; A61H 23/0254

USPC ..... 36/141

See application file for complete search history.

(56) References Cited

U.S. PATENT DOCUMENTS 4,802,463 A * 2/1989 Rojas ..... A61H 23/0263 36/1
5,113,850 A * 5/1992 Larremore ..... A43B 3/00 601/136
5,836,899 A * 11/1998 Reilly ..... A43B 3/0005 36/141
6,234,987 B1 * 5/2001 Chen ..... A43B 7/144 36/141
7,231,730 B1 * 6/2007 Ryan ..... A61H 7/001 36/141
7,347,831 B2 * 3/2008 Chiu ..... A43B 3/0005 36/141
2001/0045028 A1 * 11/2001 Crane ..... A43B 7/1415 36/44
2011/0271554 A1 * 11/2011 Jazdanian ..... A43B 3/0005 36/43
2012/0023785 A1 * 2/2012 Barnes ..... A61F 5/14 36/141
2015/0089840 A1 * 4/2015 Hsiang ..... A43B 7/06 36/102
2016/0183628 A1 * 6/2016 Usifoh ..... A43B 7/146 36/141

* cited by examiner

*Primary Examiner* — Joshua E Rodden

(74) *Attorney, Agent, or Firm* — Timothy Marc Shropshire; Eric Brandon Lovell; Garrett James O'Sullivan

(57) ABSTRACT

A massaging shoe; switchable on and off, powered by battery or other power supply and using various possible means to provide massaging including; vibration, roller balls, bearing balls and various other methods. One example would include a hard bottom core or sole made of rubber or other material in order to allow motors to be securely attached; then a gel layer that will encase the various different massaging units; there will then be an additional layer above that formed of a 'comfortable to the user' fabric or other material, which will allow movement from below to affect the wearer's feet.

7 Claims, 4 Drawing Sheets

PROFILE VIEW

MASSAGE SHOE

CROSS-REFERENCE TO RELATED APPLICATION(S)

Not applicable.

BACKGROUND OF THE INVENTION

Field of Invention

This invention relates to massaging devices for shoes.

Description of Related Art

Prior art consists of massaging devices such as that disclosed by Zummer et al. in U.S. Pat. No. 7,614,168. Zummer discloses a foot massaging device having a flexible innersole for removably inserting in an article of footwear. A thin layer of material is disposed over an upper surface of the innersole. A rechargeable battery disposed in the innersole is coupled to a switch and a charging port integrated within the innersole. A massaging effect on the bottom of a user's foot is produced by means of reciprocating rollers, inflatable bladders and/or pivoting rocker members.

The prior art does not disclose a means for charging and/or powering on/off an internal massaging shoe device from the outside of a user's shoe. This is a critical feature for individuals with certain medical conditions, such as diabetes, that have little to no feeling in their feet, thus decreasing or eliminating their ability to operate switches with their feet, as is required by Zummer. Further, a means for charging and/or powering on/off an internal massaging shoe device from the outside of a user's shoe would be hugely beneficial to individuals with limited mobility and/or flexibility, thus making it difficult for them to remove their shoes for recharging.

Based on the foregoing, there exists a need in the art for an on-demand massaging shoe device that can be used on-the-go and can be charged and powered on/off without the need for removing the user's shoe.

SUMMARY OF THE INVENTION

The present invention overcomes the deficiencies of the prior art by providing an on-demand massaging shoe device that can be used on-the-go and can be charged and powered on/off without the need for removing the user's shoe.

In an embodiment, the massaging unit has a battery, a recharge port electrically connected to the battery, a switch electrically connected to the battery, and massage modules electrically connected to the switch. The massaging unit is integrated within a shoe, such that the battery, the recharge port, and the switch are disposed within an upper portion of a tongue of the shoe, and the massage modules are disposed within the sole of the shoe.

In an embodiment, each of the massage modules has a rod, a motor in communication with a first end of the rod, an anchor connected to a second end of the rod, and extension arms extending from the rod. Each extension arm has a wheel or bearing extending from its end. The battery powers the motor which drives the rod. In an embodiment, the motor rotates the rod. In a further or alternative embodiment, the motor vibrates the rod.

In an embodiment, each of the massage modules has a spring disposed between the motor and the rod.

In an embodiment, each of the massage modules has a spring, a motor connected to a first end of the spring, an anchor connected to a second end of the spring, and extension arms extending from the spring. Each extension arm has a wheel or bearing extending from its end. The battery powers the motor, and wherein the motor vibrates the massage module In an embodiment, the massage modules are encased within a gel layer disposed between a top surface of the sole and a layer of material. The layer of material has a shape configured to extend under an entire wearer's foot.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Figure 1:
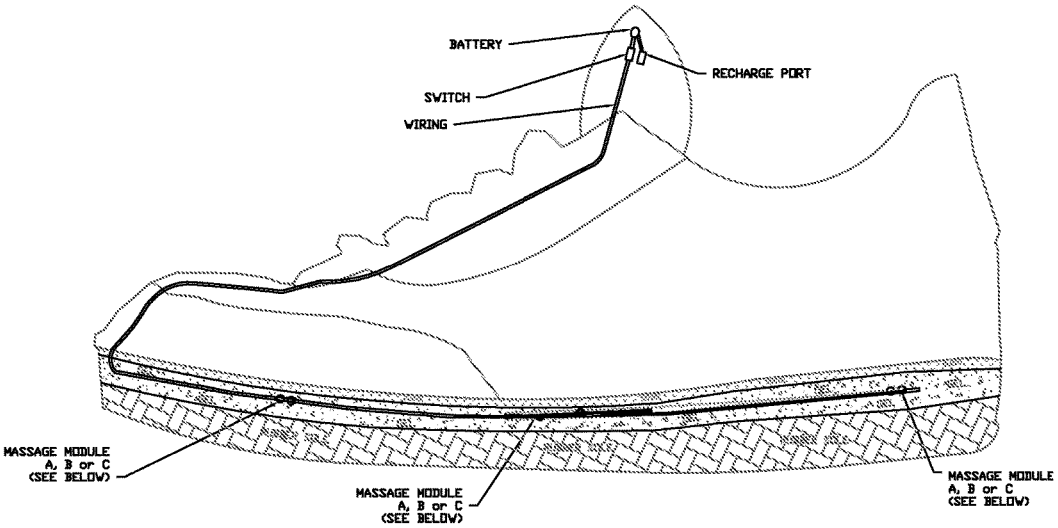
FIG. 1 shows a dissection of a shoe with the massage unit integrated therein, according to an embodiment of the present invention.

Preferred embodiments of the present invention and their advantages may be understood by referring to FIGS. 1-10, wherein like reference numerals refer to like elements.

The example item is comprised of various different units to induce massage or vibration, a motor for each necessary vibratory or massaging unit, a battery and switch and wiring to provide said power to said massaging or vibratory units and recharging capabilities. The present invention is meant to cover all available massaging means. However, we have included several suggested ways of providing the different, various methods we have already explored. However, those are just for illustration purposes only and our patent is geared towards simply a massaging shoe.

The on-demand nature of the present invention allows the user to select the appropriate time to use the needed massaging as their doctor recommends or as needed.

As shown in FIG. 1 the wearer would be able to turn on and off the massaging units, recharge the battery at his or her pleasure or convenience. The massaging units in FIG. 1 are rotating rods powered by a motor. It is suggested that the user/wearer of the shoe sit down before turning on massaging units for maximum effect.

Figure 2:
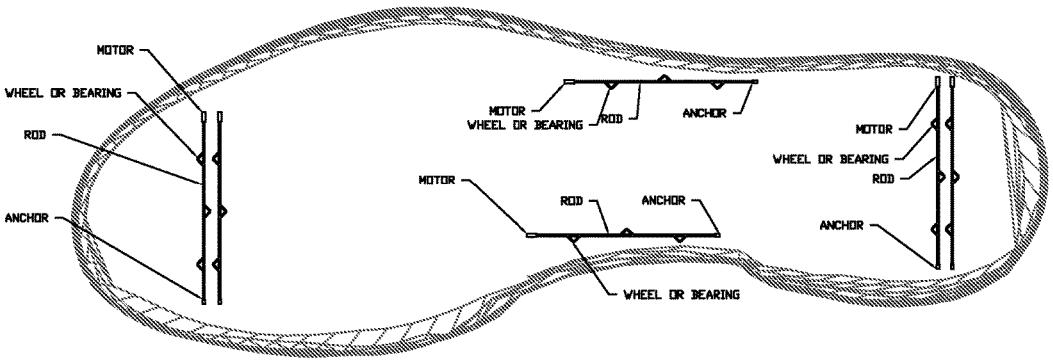
FIG. 2 shows a dissection of a shoe sole with the massage unit integrated therein, according to an embodiment of the present invention.

As shown in FIG. 2 the massage units are placed strategically to maximize the massaging effect to the wearer's foot.

Figure 3:
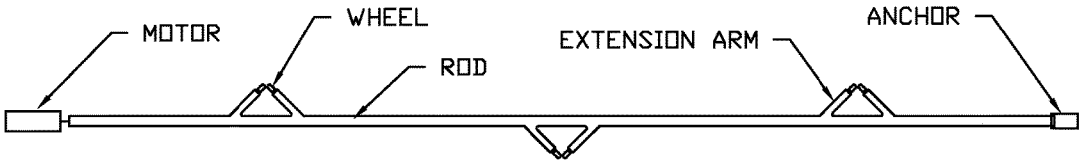
FIG. 3 shows the massage unit, according to an embodiment of the present invention.

As shown in FIG. 3 the unit can be easily manufactured and easily placed strategically in the shoe with the accompanying motor to provide rotation of said rod assembly to facilitate massaging of the foot.

Figure 4:
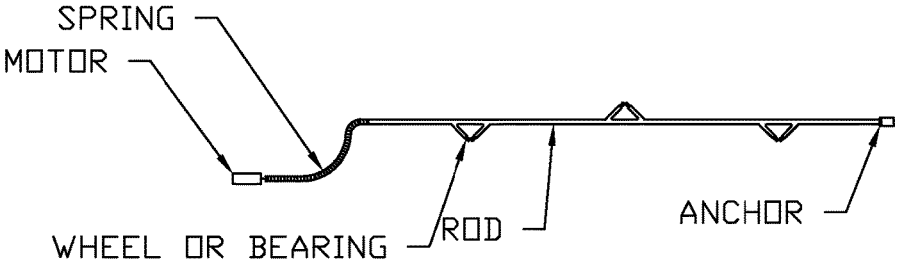
FIG. 4 shows the massage unit, according to an embodiment of the present invention.
Figure 5:
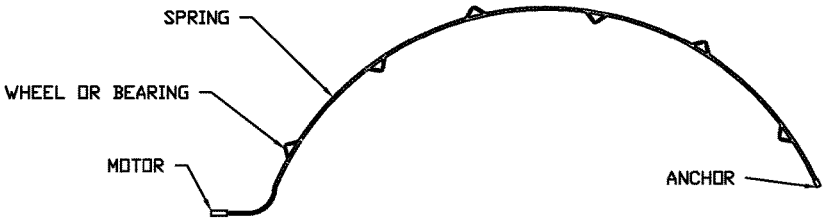
FIG. 5 shows the massage unit, according to an embodiment of the present invention.

As shown in FIGS. 4 and 5, the varying uses of materials like springs allows for placement inside the shoe to maximize massaging to the user's foot.

Figure 6:
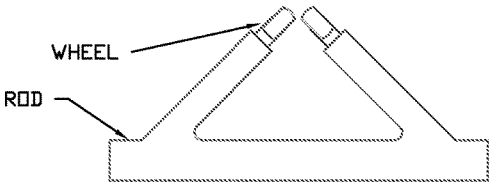
FIG. 6 shows a cutaway of the massage unit, according to an embodiment of the present invention.
Figure 7:
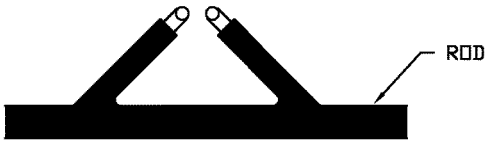
FIG. 7 shows a cutaway of the massage unit, according to an embodiment of the present invention.
Figure 8:
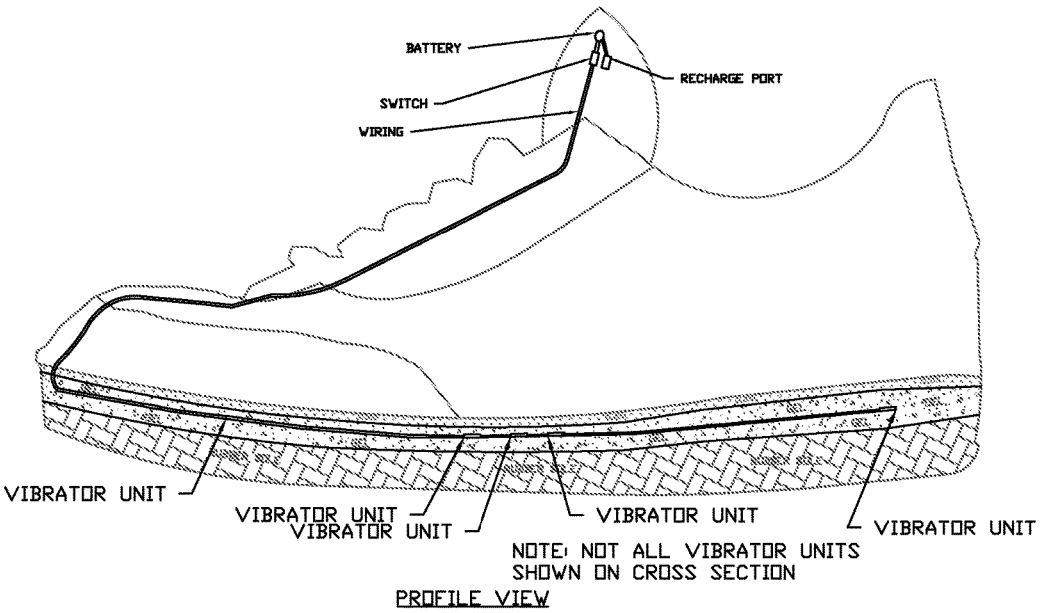
FIG. 8 shows a dissection of a shoe with the massage unit integrated therein, according to an embodiment of the present invention.

As shown in FIGS. 6 through 8, the different materials and configurations are shown for better clarification.

Figure 9:
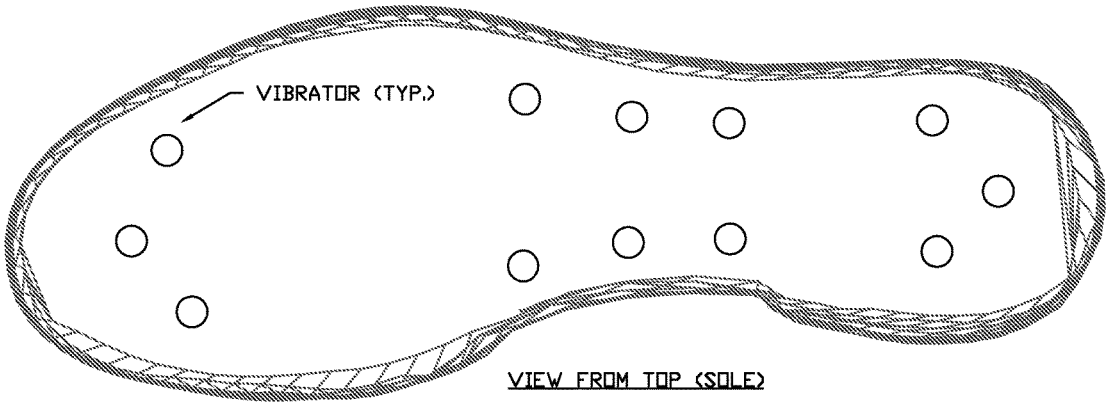
FIG. 9 shows a dissection of a shoe sole with the massage unit integrated therein, according to an embodiment of the present invention.
Figure 10:
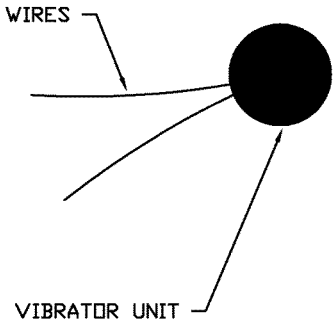
FIG. 10 shows a cutaway of the circuitry of the massage unit, according to an embodiment of the present invention.

As shown in FIGS. 9 and 10, use of commonly available vibrating units along with power supply and switches, recharge-ability would easily allow so user to enjoy a comfortable relaxing vibration in order to reenergize the user's foot.

The use of massaging and or vibrating of a user's foot increases blood flow and stimulates the nerves of a user's foot in a pleasant manner. Increasing blood flow helps rejuvenate the user's feet and helps patients with debilitating foot problems such as diabetes.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

I claim:

1. A massaging unit comprising:

a. a battery;

b. a recharge port electrically connected to the battery;

c. a switch electrically connected to the battery; and d. a plurality of massage modules electrically connected to the switch, each of the plurality of massage modules comprising:

i. a rod;

ii. a motor in communication with a first end of the rod, wherein the battery powers the motor, and wherein the motor drives the rod;

iii. an anchor connected to a second end of the rod; and iv. a plurality of extension arms extending from the rod, each extension arm comprising a wheel or bearing, wherein the massaging unit is integrated within a shoe, wherein the battery, the recharge port, and the switch are disposed within an upper portion of a tongue of the shoe, and wherein the plurality of massage modules are disposed within a sole of the shoe.

2. The massaging unit of claim 1, wherein each of the plurality of massage modules further comprise a spring disposed between the motor and the rod.

3. The massaging unit of claim 1, wherein the motor rotates the rod.

4. The massaging unit of claim 1, wherein the motor vibrates the rod.

5. The massaging unit of claim 1, wherein the plurality of massage modules are encased within a gel layer disposed between a top surface of the sole and a layer of material, wherein the layer of material has a shape configured to extend under an entire wearer's foot.

6. A massaging unit comprising:

a. a battery;

b. a recharge port electrically connected to the battery;

c. a switch electrically connected to the battery; and d. a plurality of massage modules electrically connected to the switch, each of the plurality of massage modules comprising:

i. a spring;

ii. a motor connected to a first end of the spring, wherein the battery powers the motor, and wherein the motor vibrates the massage module;

iii. an anchor connected to a second end of the spring; and iv. a plurality of extension arms extending from the spring, each extension arm comprising a wheel or bearing, wherein the massaging unit is integrated within a shoe, wherein the battery, the recharge port, and the switch are disposed within an upper portion of a tongue of the shoe, and wherein the plurality of massage modules are disposed within a sole of the shoe.

7. The massaging unit of claim 6, wherein the plurality of massage modules are encased within a gel layer disposed between a top surface of the sole and a layer of material, wherein the layer of material has a shape configured to extend under an entire wearer's foot.

* * * * *